US012116177B2

(12) United States Patent
Falzoni et al.

(10) Patent No.: US 12,116,177 B2
(45) Date of Patent: Oct. 15, 2024

(54) CAP FOR CLOSING A CONTAINER

(71) Applicant: SACMI COOPERATIVA MECCANICI IMOLA SOCIETA' COOPERATIVA, Imola (IT)

(72) Inventors: Alessandro Falzoni, Imola (IT); Marco Mazzotti, Forli' (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 158 days.

(21) Appl. No.: 17/597,287

(22) PCT Filed: Jul. 7, 2020

(86) PCT No.: PCT/IB2020/056369

§ 371 (c)(1),
(2) Date: Dec. 30, 2021

(87) PCT Pub. No.: WO2021/005505

PCT Pub. Date: Jan. 14, 2021

(65) Prior Publication Data

US 2022/0315290 A1 Oct. 6, 2022

(30) Foreign Application Priority Data

Jul. 8, 2019 (IT) ..... 102019000011124

(51) Int. Cl.
*B65D 41/34* (2006.01)
*B65D 55/16* (2006.01)

(52) U.S. Cl.
CPC ..... *B65D 41/3447* (2013.01); *B65D 55/16* (2013.01)

(58) Field of Classification Search
CPC ..... B65D 41/3447; B65D 55/16; B65D 2401/30; B65D 41/34
USPC ..... 215/252
See application file for complete search history.

(56) References Cited

U.S. PATENT DOCUMENTS 5,360,126 A * 11/1994 Snyder ..... B65D 41/3447 215/252
9,010,555 B2 4/2015 Luzzato et al.
2011/0174760 A1* 7/2011 Luzzato ..... B65D 41/48 215/258
2012/0305564 A1 12/2012 Hayashi
(Continued)

*Primary Examiner* — Nathan J Jenness
*Assistant Examiner* — Laura E. Parker
(74) *Attorney, Agent, or Firm* — PEARNE & GORDON LLP

(57) ABSTRACT

A cap for a container comprises a lateral wall extending around an axis and a transversal wall arranged transversally to the axis, a separating line being provided on the lateral wall to define:

a retaining ring intended to remain anchored to a neck of the container, and a closing element removably engageable with the neck to open or close the container.

The separating line extends around the axis and is circumferentially interrupted for defining a joining portion which joins the retaining ring and the closing element.

The cap further has an incision line which extends in the lateral wall, transversally to the axis, so that the separating line is axially interposed between the retaining ring and the incision line.

Two connecting bands are defined between the separating line and the incision line to keep the closing element connected to the retaining ring.

13 Claims, 2 Drawing Sheets

(56) References Cited

U.S. PATENT DOCUMENTS

2013/0001185 A1* 1/2013 Antier ..... B65D 55/16
215/253

* cited by examiner

Fig.1
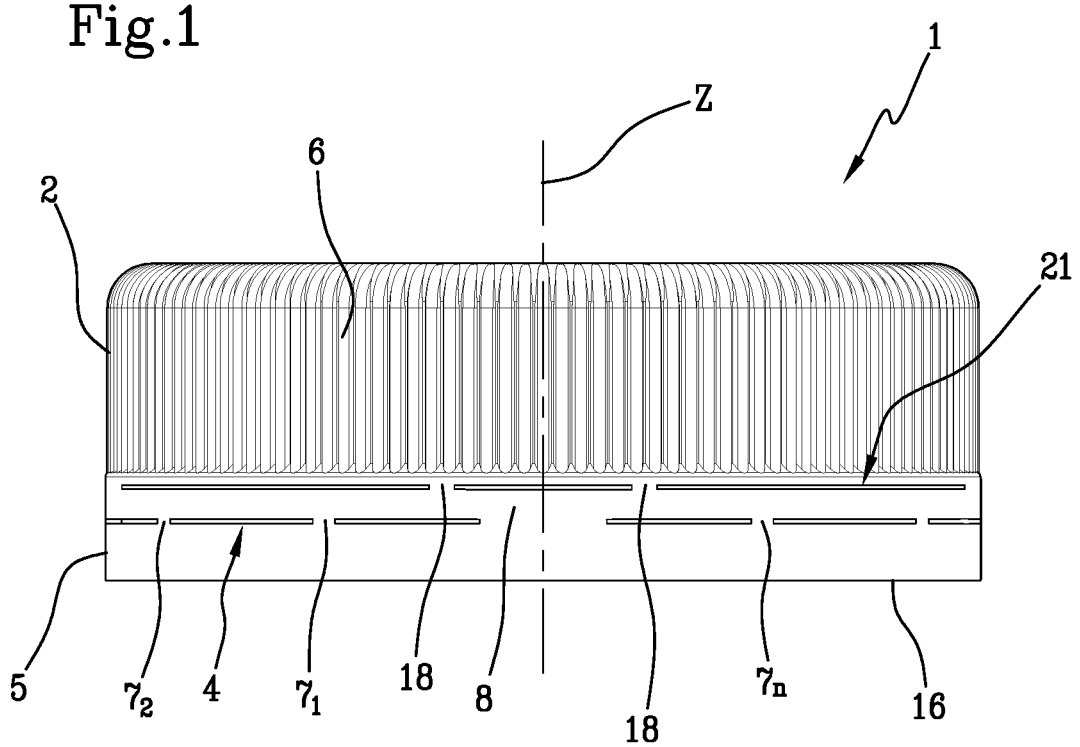
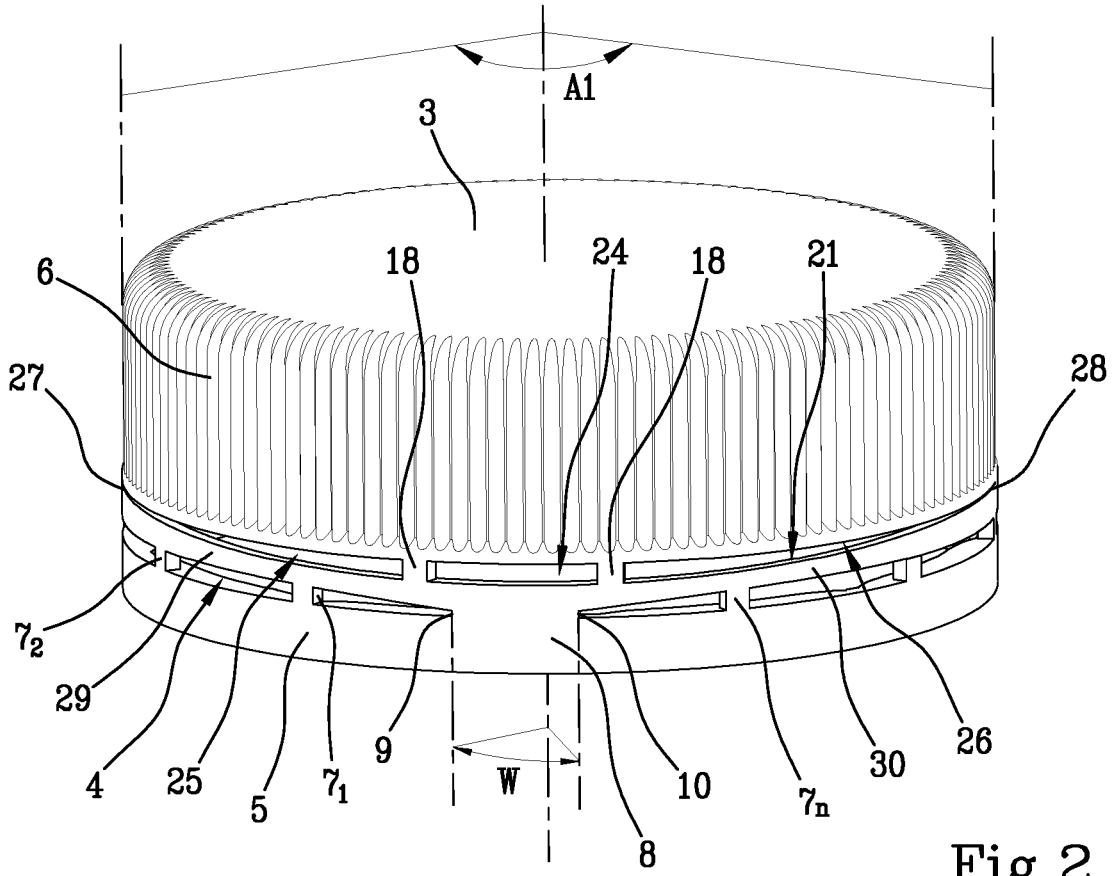
Fig.2

Fig.3
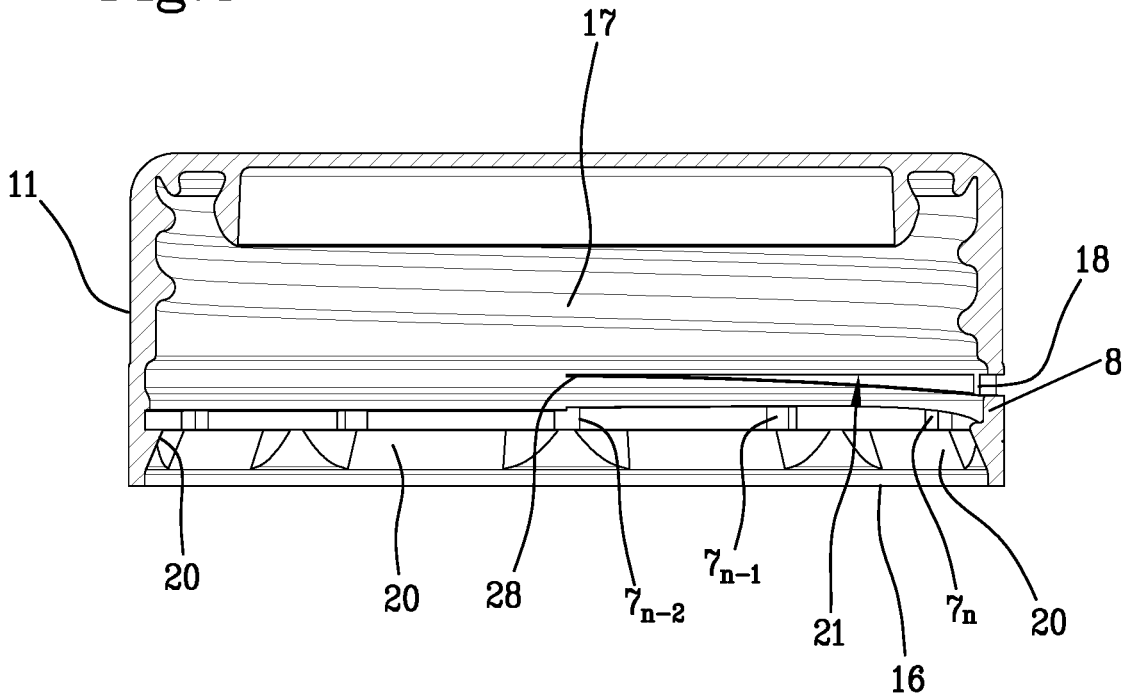
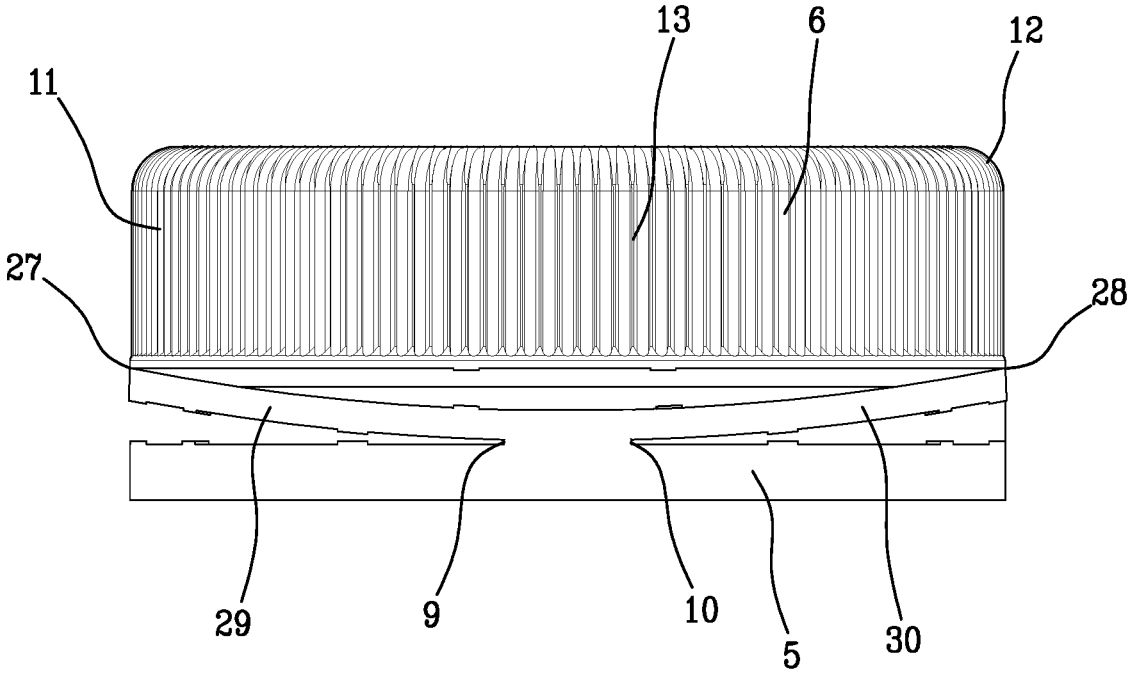
Fig.4

CAP FOR CLOSING A CONTAINER

The invention relates to a cap for a container, in particular a cap having a retaining ring, which can be associated to a container neck, the cap further having a closing element which, after opening, remains connected to the retaining ring. The cap according to the invention is particularly, but not exclusively, suitable for being applied on bottles intended to contain liquid substances.

There are prior art caps for bottles comprising a cup-shaped body provided with an inner thread suitable for engaging with an outer thread of a neck of the bottle. The prior art caps are further provided with a tamper-evident ring connected to the cup-shaped body by means of a plurality of breakable elements. When the cap is opened for the first time, the cup-shaped body separates from the tamper-evident ring following breaking of the breakable elements. The tamper-evident ring remains associated to the neck of the bottle, whilst the cup-shaped body may be unscrewed by the user, who in doing so separates the cup-shaped body from the bottle in order to access the contents of the bottle. Then, the cup-shaped body may be screwed back onto the neck so as to close the bottle again.

Sometimes, after the bottle has been emptied, the user throws the cup-shaped body on the ground, intentionally or accidentally, whilst the bottle, together with the tamper-evident ring associated to it, is correctly thrown in a waste bin.

In order to overcome this disadvantage, caps have been proposed which are provided with a retaining ring, that can be associated to a neck of a bottle, and with a closing element, connected to the retaining ring by means of a hinge. The closing element can be rotated around the hinge between an open position, in which a user can access the contents of the bottle, and a closed position, in which the closing element prevents access to the bottle. The hinge keeps the closing element joined to the retaining ring and therefore to the bottle, thereby preventing the possibility of the closing element being thrown on the ground separately from the bottle.

However, the prior art caps provided with a hinge have the disadvantage of being quite complicated to produce. Indeed, the hinge is usually made in the same mould in which the cap is obtained, in particular by means of injection moulding or compression moulding.

Therefore in order to make the prior art hinged caps, special moulds are required, which are different from those normally used to make the caps without a hinge. Such moulds are more complex than ordinary ones, in particular because the prior art hinged caps may be equipped with undercut parts, which require special devices in order to be extracted from the mould. Moreover, the prior art hinged caps may have zones with a very reduced thickness, which are difficult to obtain because the melted polymeric material does not easily flow into the mould portions intended to form such zones.

That increases the production costs of hinged caps and/or the cycle time necessary in order to obtain them.

An object of the invention is to improve the prior art caps, in particular the caps comprising a retaining ring intended to remain associated to a neck of the container and a closing element which can removably engage with the neck, to allow a user to open or alternatively close the container.

Another object is to provide a cap for a container, of the above-mentioned type, which can be made in a simple way.

A further object is to provide a cap for a container, having a closing element which remains connected to the retaining ring, which does not necessitate very complex moulds for its production.

According to the invention, there is provided a cap for a container, comprising a lateral wall extending around an axis and a transversal wall arranged transversally to the axis, a separating line being provided on the lateral wall to define:

- a retaining ring intended to remain anchored to a neck of the container, and
- a closing element removably engageable with the neck, so as to open or close the container;

wherein the separating line extends around the axis and is circumferentially interrupted for defining a joining portion which joins the retaining ring and the closing element, the cap further having an incision line which extends in the lateral wall, transversally to the axis, so that the separating line is axially interposed between the retaining ring and the incision line, two connecting bands being defined between the separating line and the incision line to keep the closing element connected to the retaining ring.

The joining portion allows the closing element to be stably kept associated to the retaining ring and therefore to the neck of the container. That prevents the possibility of the closing element being thrown on the ground separately from the container. This increases the probability that the closing element, together with the container, is correctly disposed of together with waste of the same type as it, in particular with waste made of plastic material.

The cap according to the invention may be made in a relatively simple way, without necessitating the use of special moulds. Indeed, the cap according to the invention can be made in a traditional mould, if the incision line is made by a cutting operation. It is possible by the cutting operation to obtain an incision line passing through the entire thickness of the lateral wall, or an incision line which does not pass through, at which the thickness of the lateral wall is cut only partially.

It is also possible to consider making the incision line by moulding, inside the mould in which the cap is made, but without, however, causing excessive complications of the mould, owing to the particularly simple shape of the incision line. In this case, the incision line may be shaped also as a weakening line.

The connecting bands, together with the joining portion, define a hinge arrangement which has a capacity for movement, in an axial direction, noticeably greater than the capacity for movement which would be allowed by the joining portion alone.

Indeed, that hinge arrangement makes it possible to move the closing element away from the tamper-evident ring along a significant axial distance, determined by the combination of the length of the connecting bands and of the joining portion. In this way the closing element can be easily disengaged from the neck of the container and subsequently reapplied on the neck of the container.

In one embodiment, a plurality of breakable bridges is provided along the separating line, the breakable bridges of said plurality being suitable for being broken the first time the closing element is brought into an open position.

In one embodiment, at least one breakable bridge of said plurality is arranged in a position which, around the axis, is interposed between the joining portion and one end of the incision line.

In this way it is possible to obtain good stability of the cap during its application on the neck, even if the incision line has a significant angular extent.

The invention can be better understood and implemented with reference to the accompanying drawings, which illustrate an example, non-limiting embodiment of it, in which:

FIG. 1 is a schematic rear view of a cap for a container, in a closed position;

FIG. 2 is a perspective view of the cap of FIG. 1, in a configuration wherein a closing element of the cap begins to be moved away from a retaining ring;

FIG. 3 is a cross-section of the cap of FIG. 1, in the configuration of FIG. 2, taken along a centre line plane of a joining portion which joins the closing element to the retaining ring;

FIG. 4 is a schematic rear view like that of FIG. 1, showing the closing element which is about to be brought into an open position.

FIGS. 1 to 4 show a cap 1 for closing a container, in particular a bottle intended to contain a liquid substance such as a drink. The cap 1 is made of polymeric material. Any polymeric material suitable for moulding may be used to obtain the cap 1.

The cap 1 is shown in FIG. 1 in a closed position in which the cap 1 is found when it leaves a cap production line, ready to be applied on the container. In this condition, the cap 1 comprises a lateral wall 2 which extends around an axis Z, and a transversal wall 3 arranged at one end of the lateral wall 2, so as to close that end. The transversal wall 3 extends transversally, in particular perpendicularly, to the axis Z. The transversal wall 3 may be flat, even though other shapes are theoretically possible. In the example illustrated, the transversal wall 3 has a substantially circular shape in plan view.

The cap 1 has a separating line 4, positioned on the lateral wall 2 and extending around the axis Z. The separating line 4 extends in a plane arranged transversally, in particular perpendicularly, to the axis Z. The separating line 4 defines on the cap 1 a retaining ring 5 and a closing element 6. The latter are arranged on opposite sides of the separating line 4. As described in more detail below, when the cap 1 is moved to an open position, the closing element 6 separates from the retaining ring 5 along the separating line 4.

The separating line 4 may be parallel to a free edge 16 of the cap 1. More specifically, the free edge 16 delimits the retaining ring 5 on the opposite side to the transversal wall 3.

The separating line 4 does not extend for an entire angle of 360° around the axis Z. The separating line 4 is circumferentially interrupted, so as to define on the lateral wall 2 a joining portion 8, at which the closing element 6 remains joined to the retaining ring 5.

In other words, the separating line 4 has a first end 9 and a second end 10. The joining portion 8 is interposed between the first end 9 and the second end 10. At the joining portion 8, the retaining ring 5 is joined to the closing element 6.

As shown in FIG. 2, the joining portion 8 has an angular dimension W around the axis Z.

The joining portion 8 defines a hinge band around which the closing element 6 can rotate after having disengaged from a neck of the container on which the cap 1 is applied.

This hinge band extends between two opposite end zones of the joining portion 8, that is to say, it extends from a zone of the joining portion 8 immediately adjacent to the first end 9 to a zone of the joining portion 8 immediately adjacent to the second end 10.

The hinge band defined by the joining portion 8 therefore affects the entire angular dimension W of the joining portion 8, without the interposing of arrow shaped hinges or of reduced thickness zones.

Therefore, if considering any plane perpendicular to the axis Z, for example a plane containing the separating line 4, the thickness of the joining portion 8 in that plane may be substantially constant.

The joining portion 8 may be delimited by a smooth outer surface, in particular having the shape of a portion of cylinder.

A plurality of breakable bridges $\mathbf{7}_1, \mathbf{7}_2 \ldots \mathbf{7}_n$ is provided along the separating line 4, the breakable bridges $\mathbf{7}_1, \mathbf{7}_2 \ldots \mathbf{7}_n$ of said plurality connecting the retaining ring 5 to the closing element 6. The breakable bridges $\mathbf{7}_1, \mathbf{7}_2 \ldots \mathbf{7}_n$ are intended to be broken the first time the closing element 6 is brought into an open position, to signal that the container is no longer whole. In particular, $\mathbf{7}_1$ denotes the breakable bridge which is nearest to the first end 9 of the separating line 4, whilst $\mathbf{7}_n$ denotes the breakable bridge which is nearest to the second end 10 of the separating line 4.

The breakable bridges $\mathbf{7}_1, \mathbf{7}_2 \ldots \mathbf{7}_n$ may be angularly equally spaced along the separating line 4.

In the example illustrated, the closing element 6 has a cup-shaped body and comprises a skirt 11 which extends around the axis Z. The skirt 11 is connected to the transversal wall 3, arranged at the opposite end of the skirt 11 to the separating line 4. In particular, the skirt 11 is connected to the transversal wall 3 by a connecting zone 12, which may be shaped, in cross section, like a bevelled edge or a rounded edge.

As shown in FIG. 3, on an inner surface of it, the skirt 11 is provided with removable fixing means, by means of which the closing element 6 can removably engage with the neck of the container. The removable fixing means may comprise, for example, an inner thread 17 intended to engage with an outer thread formed on the neck.

On an outer surface of it, the skirt 11 may be provided with a plurality of knurling lines 13, extending parallel to the axis Z and suitable for facilitating gripping of the cap 1 by the user or by a capping machine which applies the cap 1 on the container to be closed.

The knurling lines 13 may continue also in the connecting zone 12 and/or in the retaining ring 5.

The retaining ring 5 extends between the free edge 16 and the separating line 4. The retaining ring 5 may be delimited by a cylindrical outer surface.

In the closed position of the cap 1 shown in FIG. 1, the retaining ring 5 is coaxial with the closing element 6.

The retaining ring 5 is internally provided with an engaging structure which may comprise a plurality of engaging elements 20, shown in FIG. 3, which project inwards from the retaining ring 5. The engaging elements 20 may be shaped as thickened portions of the retaining ring 5, that is to say, as portions of the retaining ring 5 having a greater thickness than the surrounding zones of the retaining ring 5.

The engaging structure is suitable for engaging with a circular enlargement which projects from an outer surface of the neck. In particular, when the cap 1 is applied on the neck for the first time, the engaging structure is positioned below the circular enlargement, that is to say, on the side of the circular enlargement directed towards the body of the container. The engaging structure is configured to abut against the circular enlargement so as to prevent axial movements of the retaining ring 5, away from the neck, when the closing element 6 is removed from the neck. In this way, the engaging structure guarantees that, when the closing element 6 is brought into an open position, the retaining element 5 remains joined to the neck of the container.

In an alterative embodiment not illustrated, the engaging structure may comprise a single annular element which is bent around the free edge 16 towards the inside of the retaining ring 5. In another alternative embodiment not illustrated, the engaging structure may comprise a plurality of engaging elements, shaped like tabs which project from the free edge 16 and are bent towards the inside of the retaining ring 5. Alternatively, the engaging structure may comprise an enlargement, continuous or interrupted, which from an inner surface of the retaining ring 5 projects towards the axis Z to engage with the circular enlargement of the neck.

As shown in FIGS. 1 to 4, the cap 1 has an incision line 21 which extends on the lateral wall 2 transversally, in particular perpendicularly, to the axis Z. The incision line 21 may lie in a plane arranged transversally, in particular perpendicularly, to the axis Z.

In more detail, the incision line 21 is provided in the closing element 6, in a position which may be interposed between the separating line 4 and the removable fixing means by which the closing element 6 can be removably fixed to the neck of the container.

In this way, the separating line 4 is axially interposed between the retaining ring 5 and the incision line 21. This means that a hypothetical observer moving parallel to the axis Z from the free edge 16 towards the lateral wall 3, in a region of the cap 1 in which both the separating line 4 and the incision line 21 are present, encounters first the retaining ring 5, then the separating line 4 and finally the incision line 21.

If the cap 1 is positioned in the same orientation which it will have after having been applied to the container, that is to say, with the transversal wall 3 directed upwards, the incision line 21 is arranged at a level higher than the separating line 4. The incision line 21 is therefore arranged on the same side as the closing element 6, relative to the separating line 4.

The joining portion 8 and the retaining ring 5 are arranged on the same side of the incision line 21. The incision line 21 delimits the joining portion 8, in a plane transversal to the axis Z, on the side of the joining portion 8 furthest from the retaining ring 5.

The incision line 21 has one end 27 and a further end 28, that is to say, it extends between the end 27 and the further end 28.

The incision line 21 has an angular extent A1, measured around the axis Z, greater than the angular distance (also measured around the axis Z) between the first end 9 and the second end 10 of the separating line 4, that is to say, the angular dimension W of the joining portion 8. The angular extent A1 of the incision line 21 may be defined as the angular distance (that is to say, measured as an angle around the axis Z) between the end 28 and the further end 27 of the incision line 21.

For example, the angular extent A1 of the incision line 21 may be between 150° and 200°, preferably greater than 180°. The angular dimension W of the joining portion 8 around the axis Z, that is to say, the angular distance between the first end 9 and the second end 10 of the separating line 4, may be between 5° and 40°, preferably between 10° and 30°.

In the example illustrated, the joining portion 8 is centred relative to the separating line 21. In other words, the midpoint of the separating line 21 and the centre line of the joining portion 8 are aligned with each other in a direction parallel to the axis Z, that is to say, they lie in a common plane which contains the axis Z. This condition is not however necessary, since even a not perfectly centred positioning of the incision line 21 relative to the joining portion 8 is permitted.

In the example illustrated, the incision line 21 has a flat curved shape. However, other shapes are possible.

The incision line 21 and the separating line 4 may lie in respective parallel planes, even though this condition is not necessary. For example, the incision line 21 and the separating line 4 could lie in planes slightly inclined relative to each other. Alternatively, the incision line 21 could comprise a plurality of stretches having different inclinations, not necessarily coplanar with each other.

The end 27 of the incision line 21 extends outside the joining portion 8, beyond the first end 9 of the separating line 4 relative to a centre line plane of the joining portion 8. The further end 28 also extends outside the joining portion 8, but goes beyond the second end 10 of the separating line 4, relative to the centre line plane of the joining portion 8.

The incision line 21 comprises a central part 24 interposed between a peripheral part 25 and a further peripheral part 26. The central part 24 faces the joining portion 8. The peripheral part 25 faces the separating line 4, in particular at an end portion of the separating line 4. More precisely, the peripheral part 25 faces the separating line 4 in a zone between the first end 9 of the separating line 4 and the end 27 of the incision line 21. The further peripheral part 26 faces the separating line 4, in particular a further end portion of the separating line 4. More precisely, the further peripheral part 26 faces the separating line 4 in a zone between the second end 10 of the separating line 4 and the further end 28 of the incision line 21.

Between the peripheral part 25 of the incision line 21 and a portion of the separating line 4 which starts from the first end 9, a connecting band 29 is defined for keeping the closing element 6 connected to the retaining ring 5. Similarly, between the further peripheral part 26 of the incision line 21 and a further portion of the separating line 4 which starts from the second end 10, a further connecting band 30 is defined for keeping the closing element 6 connected to the retaining ring 5.

In the example illustrated, the connecting band 29 and the further connecting band 30 are arranged symmetrically to each other relative to a plane containing the axis Z and a centre line of the joining portion 8.

The incision line 21 may be shaped as a through cut which passes through the entire thickness of the lateral wall 2.

Along the incision line 21 one or more further breakable bridges 18 are provided which join an edge of the incision line 21 nearest to the retaining ring 5 to an edge of the incision line 21 furthest from the retaining ring 5.

The further breakable bridges 18 are intended to be broken the first time the closing element 6 is brought into the open position.

In the example illustrated, there are two further breakable bridges 18 arranged along the incision line. However, this condition is not necessary.

For example, the number of further breakable bridges 18 could be equal to, or greater than, three.

In the example illustrated, one of the further breakable bridges 18 is arranged in a position which, around the axis, is interposed between the first end 9 of the separating line 4 and the first breakable bridge Ti located along the separating line 4, that is to say, the breakable bridge of the separating line 4 which is nearest to the first end 9.

The first breakable bridge Ti may be arranged at a short angular distance, for example less than 10°, preferably less than 5°, from the first end 9 of the separating line 4.

Moreover, another of the further breakable bridges 18 is arranged in a position which, around the axis, is interposed between the second end 10 of the separating line 4 and the last breakable bridge $7_n$ located along the separating line 4, that is to say, the breakable bridge of the separating line 4 which is nearest to the second end 10.

The last breakable bridge $7_n$ may be arranged at a short angular distance, for example less than 10°, preferably less than 5°, from the second end 10 of the separating line 4.

The further breakable bridges 18 present along the incision line 21 are helpful when the cap 1 is applied on the neck of the container for the first time by a capping machine, since they hold together the facing edges of the incision line 21, preventing excessive deformations in the joining portion 8 zone.

The breakable bridges $7_1$, $7_2$, . . . $7_n$ provided along the separating line 4 may be arranged in a staggered position, around the axis Z, relative to the further breakable bridges 18 provided along the incision line 21.

At least one breakable bridge Ti of the plurality of breakable bridges $7_1$, $7_2$, . . . $7_n$ provided along the separating line 4 is interposed, around the axis Z, between the joining portion 8 (or more specifically the first end 9 of the separating line 4) and the end 27 of the incision line 21.

In the example illustrated, at least two breakable bridges $7_1$, $7_2$ provided along the separating line 4 may be interposed, around the axis Z, between the joining portion 8 and the end 27 of the incision line 21. Another breakable bridge of the plurality of breakable bridges $7_1$, $7_2$, . . . $7_n$ may be axially aligned, or almost, with the end 27 of the incision line 21.

Moreover, at least one breakable bridge $7_n$ of the plurality of breakable bridges $7_1$, $7_2$, . . . $7_n$ provided along the separating line 4 is interposed, around the axis Z, between the joining portion 8 (or more specifically the second end 10 of the separating line 4) and the further end 28 of the incision line 21.

In the example illustrated, at least two breakable bridges $7_{n-1}$, $7_n$ provided along the separating line 4 may be interposed, around the axis Z, between the joining portion 8 and the further end 28 of the incision line 21. Another breakable bridge $7_{n-2}$ of the plurality of breakable bridges $7_1$, $7_2$, . . . $7_n$ may be axially aligned, or almost, with the further end 28 of the incision line 21, as shown in FIG. 3.

This distribution of the breakable bridges $7_1$, $7_2$, . . . $7_n$ allows the avoidance of excessive deformations of the retaining ring 5, of the connecting band 29 and of the further connecting band 30, in particular when the cap 1 is applied for the first time on the neck by the capping machine. That is particularly useful when the angular extent A1 of the incision line 21 is significant, for example close to 180° or even greater.

The cap 1 is applied on the neck of the container in the closed position shown in FIG. 1. The cap 1 is positioned in such a way that the engaging elements 20 provided on the inside of the retaining ring 5 are below the circular enlargement present on the neck.

When the user wishes to open the container for the first time, the user grips the skirt 11 of the closing element 6 and rotates the closing element 6 around the axis Z, in order to unscrew the closing element 6 from the neck. Initially, the closing element 6 and the retaining ring 5 are rotated together around the axis Z, and they simultaneously move together in a direction parallel to the axis Z, away from the neck. This occurs until the engaging elements 20 of the retaining ring 5 abut against the circular enlargement provided on the neck. At this point, the circular enlargement of the neck prevents the retaining ring 5 from rising further along the axis Z, acting as a stop for the movement of the retaining ring 5 away from the neck.

The closing element 6, which is unscrewed by the user, continues to move along the axis Z away from the neck. The breakable bridges $7_1$, $7_2$, . . . , $7_n$ and the further breakable bridges 18 are thereby tensioned, as shown in FIGS. 2 and 3.

Continuing to unscrew the closing element 6, the pulling strain acting on the breakable bridges $7_1$, $7_2$, . . . , $7_n$ and on the further breakable bridges 18 causes the breakable bridges $7_1$, $7_2$, . . . , $7_n$ and the further breakable bridges 18 to break, as shown in FIG. 4.

The closing element 6 consequently separates from the retaining ring 5 along the separating line 4, but remains joined to the retaining ring 5 at the joining portion 8.

The first connecting band 29 and the second connecting band 30 are in turn separated from the adjacent regions of the closing element 6.

Moreover, the first connecting band 29 and the second connecting band 30 deform. In particular, by moving the closing element 6 upwards, the first connecting band 29 and the second connecting band 30 are also pulled upwards. Consequently, the first connecting band 29 and the second connecting band 30 are spaced apart from both the retaining ring 5 and the closing element 6 and remain joined to each other in the joining portion 8.

The first connecting band 29 and the second connecting band 30 thus adopt a kind of upside down trapezium shape as shown in FIG. 2, in which the neck of the container has not been shown. In this configuration, the first connecting band 29 remains joined to the closing element 6 at the end 27 of the incision line 21. Similarly, the second connecting band 30 remains joined to the closing element 6 at the further end 28 of the incision line 21.

The first connecting band 29 and the second connecting band 30 are joined to each other in the joining portion 8.

In other words, the first connecting band 29 and the second connecting band 30 are arranged in an inclined configuration relative to the retaining ring 5 and converge in the joining portion 8.

Continuing to unscrew the closing element 6, the latter disengages from the outer thread formed on the neck, so that the container can be opened. In contrast, the retaining ring 5 remains anchored to the neck. The first connecting band 29, the second connecting band 30 and the joining portion 8 form a hinge arrangement around which the closing element 6 can rotate to allow the user to access the contents of the container.

In particular, by moving the closing element 6 around the hinge arrangement after the closing element 6 has been disengaged from the neck, it is possible to move the closing element 6 into a lateral position relative to the neck, so that the closing element 6 is no longer coaxial with the retaining ring 5.

After use, the user can return the cap 1 to the closed position shown in FIG. 1 by a sequence of operations in reverse order compared with that previously described.

The first connecting band 29 and the second connecting band 30 allow a hinge arrangement to be obtained which is longer than that which would be available if only the hinge band defined by the joining portion 8 were present. This makes it easier to disengage the closing element 6 from the neck, and to reapply the closing element 6 on the neck, by rotating the closing element 6 around the hinge arrangement.

The breakable bridges $7_1$, $7_2$, . . . , $7_n$ and the further breakable bridges 18 allow a sufficient cap 1 rigidity to be maintained when the latter is applied on the container for the first time, even if the incision line 21 has a significant angular extent A1.

The invention claimed is:

1. A cap for a container, comprising a lateral wall extending around an axis and a transversal wall arranged transversally to the axis, a separating line being provided on the lateral wall to define:

a retaining ring intended to remain anchored to a neck of the container, and a closing element removably engageable with the neck to open or close the container; wherein the separating line extends around the axis and is circumferentially interrupted for defining a joining portion which joins the retaining ring and the closing element, the cap further having an incision line which extends in the lateral wall, transversally to the axis, so that the separating line is axially interposed between the retaining ring and the incision line, two connecting bands being defined between the separating line and the incision line to keep the closing element connected to the retaining ring, wherein a plurality of breakable bridges is provided along the separating line, the breakable bridges of said plurality being suitable for being broken the first time the closing element is brought into an open position, and wherein a plurality of further breakable bridges is provided along the incision line, at least one further breakable bridge of said plurality of further breakable bridges being arranged in a position which, around the axis, is interposed between the joining portion and a breakable bridge of said plurality of breakable bridges which is nearest to the joining portion.

2. A cap according to claim 1 wherein at least one breakable bridge of said plurality is arranged in a position which, around the axis, is interposed between the joining portion and one end of the incision line.

3. A cap according to claim 1, wherein two breakable bridges of said plurality are arranged in a position which, around the axis, is interposed between the joining portion and one end of the incision line.

4. A cap according to claim 1, wherein a breakable bridge of said plurality is substantially aligned, in a circumferential direction with respect to the axis, with one end of the incision line.

5. A cap according to claim 1, wherein the incision line has an angular extent around the axis of between 150° and 200°.

6. A cap according to claim 5, wherein the angular extent of the incision line around the axis is greater than 180°.

7. A cap according to claim 1, wherein the joining portion has a substantially constant thickness in a plane perpendicular to the axis.

8. A cap according to claim 1, wherein a connecting band of said two connecting bands is defined between a peripheral part of the incision line and an end portion of the separating line, a further connecting band of said two connecting bands being defined between a further peripheral part of the incision line and a further end portion of the separating line.

9. A cap according to claim 8, wherein the connecting band is arranged symmetrically to the further connecting band relative to a plane containing the axis and a centre line of the joining portion.

10. A cap according to claim 1, wherein the incision line and the separating line extend in respective parallel planes.

11. A cap according to claim 1, wherein the joining portion has an angular dimension around the axis of between 5° and 40°.

12. A cap according to claim 11, wherein the angular dimension of the joining portion around the axis is between 10° and 30°.

13. A cap according to claim 1, wherein the closing element is provided with an inner thread suitable for engaging with an outer thread of the neck.

* * * * *